US006486397B2

(12) United States Patent
Lee

(10) Patent No.: US 6,486,397 B2
(45) Date of Patent: Nov. 26, 2002

(54) APPARATUS FOR RECEIVING UNIVERSAL SERIAL BUS CABLES

(75) Inventor: Marx Lee, Shin-Chu (TW)

(73) Assignee: Mustek Systems, Inc. (TW)

( * ) Notice: Subject to any disclaimer, the term of this patent is extended or adjusted under 35 U.S.C. 154(b) by 0 days.

(21) Appl. No.: 09/778,083

(22) Filed: Feb. 7, 2001

(65) Prior Publication Data

US 2002/0106933 A1 Aug. 8, 2002

(51) Int. Cl.[7] ..... H01J 5/00

(52) U.S. Cl. ..... 174/50; 174/53; 220/3.8; 220/4.02

(58) Field of Search ..... 174/49, 50, 58, 174/63, 17 R, 60, 135; 220/3.8, 4.02; 439/535; 248/906

(56) References Cited

U.S. PATENT DOCUMENTS 5,333,509 A * 8/1994 Dimen ..... 73/862.391
5,533,637 A * 7/1996 Williams, Jr. ..... 220/3.8
5,568,362 A * 10/1996 Hansson ..... 174/50 X
5,837,936 A * 11/1998 Rogers et al. ..... 174/65 R
6,184,461 B1 * 2/2001 Flegel ..... 174/50
6,316,728 B1 * 11/2001 Hoover et al. ..... 174/135 X

* cited by examiner

*Primary Examiner*—Dean A. Reichard
*Assistant Examiner*—Dhiru R Patel
(74) *Attorney, Agent, or Firm*—Lowe Hauptman Gilman & Berner, LLP

(57) ABSTRACT

An apparatus for receiving a USB cable and a USB plug head includes a receiving portion, at least one clip and at least one USB plug base. The gap is formed between the clip and the side wall of the receiving portion for securing the USB cable. The USB plug head is inserted to the USB plug base which is formed by a first side plate, a second side plate, a first fixing plate and a second fixing plate. Moreover, there is cover which may close the receiving portion for advanced securing purpose.

20 Claims, 4 Drawing Sheets

APPARATUS FOR RECEIVING UNIVERSAL SERIAL BUS CABLES

BACKGROUND OF THE INVENTION

1. Field of the Invention

The present invention generally relates to a device for receiving USB (Universal Serial Bus) cables, especially for receiving USB cables employed in a scanning means.

2. Background Description

Personal computers have been fully developed to many utilization applications for many fields, such as medical care, business, studying, education and so on. For the diversified applications, there are many peripheral devices are developed to cooperate with the personal computer to achieve some specific functions. Some of the peripheral devices are connected with the personal computer with cables. Because of the convenience, using USB cables are becoming more and more popular.

Therefore, scanning devices are broadly using USB cables to be connected with computers. As shown in FIG. 1, scanning device 1 includes a USB cables 22 and a USB plug head 20. In this case, when the user has the need to move the scanning device 1, the user has to unplug the USB cable. Since there is no particular device to receive the unplugged USB cable, the user always hands the scanning device along with the USB cable outside the scanning device during necessary moving. In this case, it is inconvenient and ungrateful. Moreover, this traditional method even increases the possibility to damage the exposed USB plug head.

For the above concerns, the present invention has provided a device for receiving the USB cable and its plug head.

SUMMARY OF THE INVENTION

It is therefore an object of the present invention to provide an apparatus for receiving USB cable and its plug head to reduce the possibility to damage the USB cables and its plug head during transportation.

It is therefore another object of the present invention to provide an apparatus for receiving USB cable and its plug head to avoid unexpected lost during transportation, and further to improve the graceful outlook.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
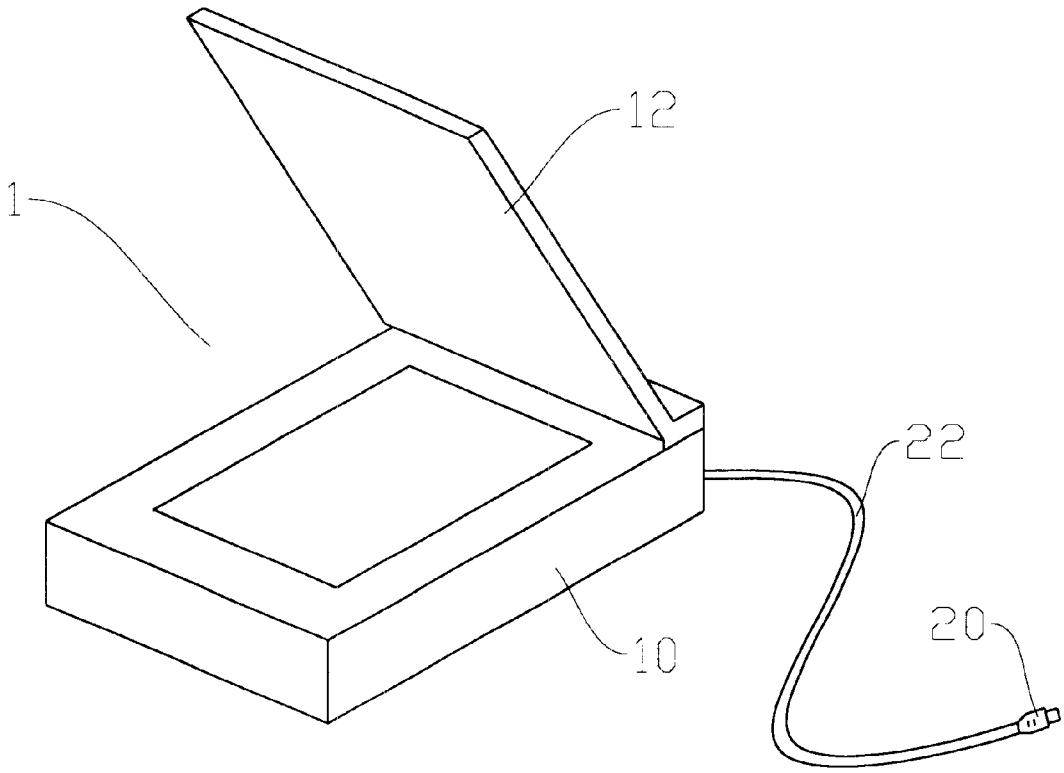
Fig. 1 (PRIOR ART)
FIG. 1 is a schematic demonstration of a traditional scanning device.
Figure 2:
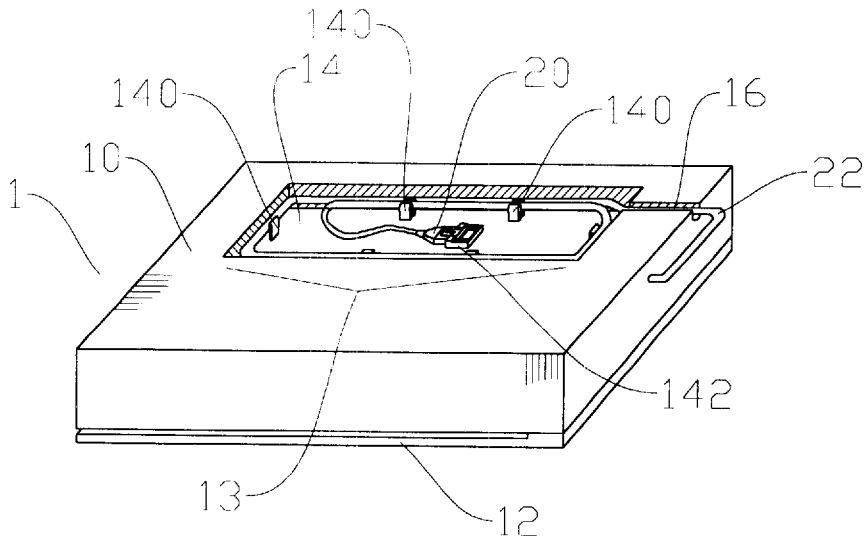
FIG. 2 demonstrates the first embodiment of the present invention.

Please refer to FIG. 2. FIG. 2 shows the first embodiment of the present invention. The USB cable receiving device 13 is located on the bottom of the body 10 of the scanning device 1. The scanning device 1 can be any type of peripheral device. Nevertheless, the receiving device 13 could be placed on the side of the body 10 of the scanning device 1 if this application is preferred by the designer or suitable to the actual office environment.

The receiving device includes receiving portion 14 which is caving into the body 10. The USB cable 22 and the USB plug head 20 are placed inside the receiving portion. Therefore, the cable 22 and the plug head 20 will not expose outside the scanning device 1. For the purposes to fixing the received USB cable 22 and to adjust the length of the USB cable 22 in the receiving portion 14, there are placed plural clips 140 to hold the USB cable 22. Further, there is at least one USB plug base 142 for connecting the USB plug head 20.

Figure 3A:
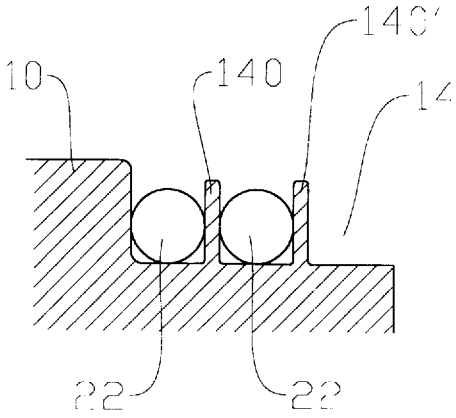
FIG. 3A is a cross section showing the relating position of a clip element and the USB cable.
Figure 3B:
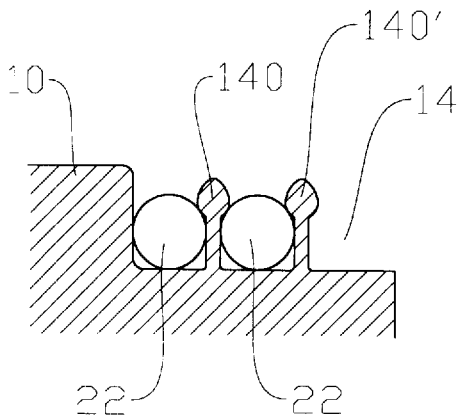
FIG. 3B is a cross section showing the relating position of another clip element and the USB cable.

The clip 140 is located at the receiving portion 14 and having a gap from the side wall of the receiving portion 14, as shown in FIG. 3A. The width of the gap is little less than the diameter of the USB cable 22. Further, the clip 140 is made by elastic material. When the USB cable 22 is inserted into the gap, the USB cable 22 can be held tight by the force from the clip 140 and the side wall of the receiving portion 14. For the consideration to improve the clip 140, an advanced clip 140 can be designed with a bolt in the end as shown in FIG. 3B. The position of clip 140' of FIG. 3B is the same as shown in FIG. 3A. The gap between the clip 140' and the side wall is also less than the diameter of the USB cable 22. In view of the above, when each side of the receiving portion is placed with at least one clip, the user can store the USB cable 22 around the clips and make the USB cable 22 completely inside the scanning device. Besides, if the clips are produced with the receiving portion in the same piece during manufacturing, it would save cost and assembling time.

Figure 4A:
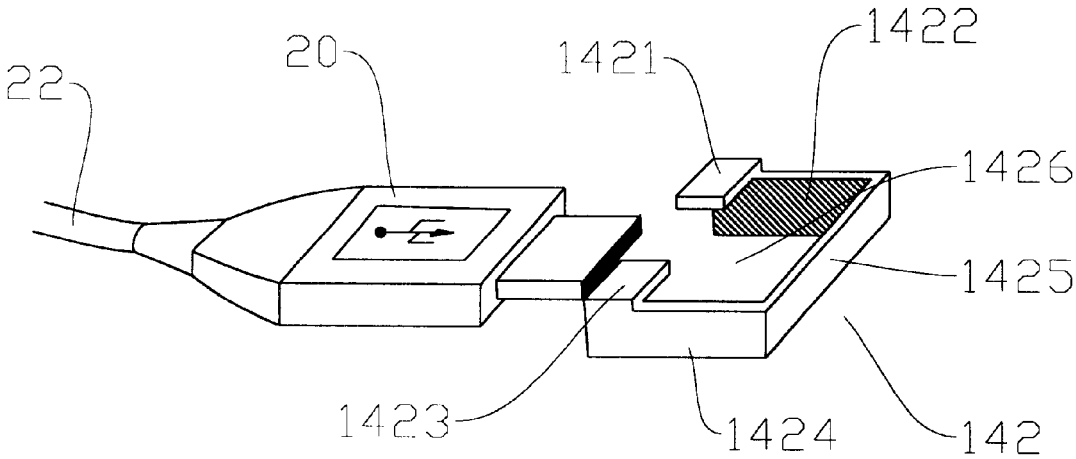
FIG. 4A shows that the USB plug head does not plug into the USB plug base.
Figure 4B:
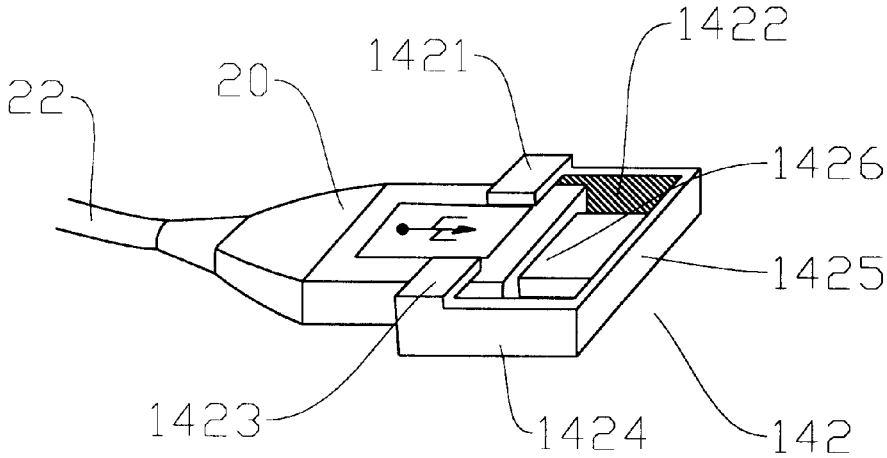
FIG. 4B shows USB plug head being plugging into the plug base.

Moreover, there is a USB cable base 142, located in the receiving portion 14, for docketing the USB plug head 20 as shown in FIGS. 4A and 4B. The USB plug head 20 has a first side plate 1422, a first fixing plate 1421, a second side plate 1424 and a second fixing plate 1423. The first side plate 1422 and the second side plate 1424 are mounted on the receiving portion 14 and forming a plug space 1426. The width of the plug space 1426 is equal or longer than the width of the USB plug head 20 in order to firmly hold the USB plug head 20. The first fixing plate 1421 is connected to the first side plate 1422. The formed height by the first side plate 1422 and the first fixing plate 1421 is equal or higher than the height of the USB plug head 20 also in order to hold the plug head tight. For the same reason, the second fixing plate 1423 is connected to the second side plate 1424. The formed height by the second side plate 1424 and the second fixing plate 1423 is equal or higher than the height of the USB plug head 20 also in order to hold the plug head tight. The angles between the first side plate 1422 and the receiving portion 14, and also between the second side plate 1424 and the receiving portion 14, are ninety (90) degrees. However, the angles may be over ninety degrees. In this case, the minimum width between the first side plate 1422 and the second side plate 1424 have to be longer than the width of the USB plug head 20 for properly inserting the plug head into the plug space 1426. Please refer to FIG. 4B. In order to enhance the rigidity of the USB plug base 142, there is a connecting plate 1425 which connects the first side plate 1422 and the second side plate 1424.

Accordingly, if proper tolerance and sharp degree are set to the USB plug base, the USB plug head can be well held by just one side plate and one fixing plate.

Because the receiving portion 14 is caved into the bottom of the scanning device 1 and the USB cable 22 is connected to a computer outside the body 10, a guiding opening 16 is located from the receiving portion 14 to the outside. The guiding opening 16 can completely receive the USB cable 22 and help the standing stability due to smooth bottom surface of the scanning device 1.

Figure 5A:
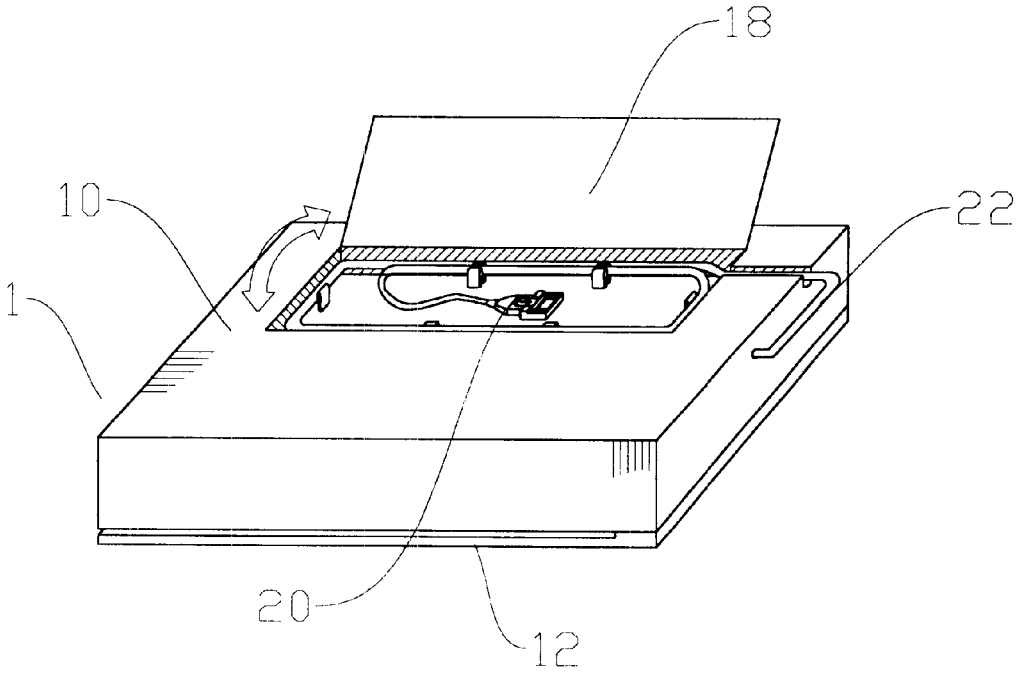
FIG. 5A shows the second embodiment of the present invention while the cover is at open position.
Figure 5B:
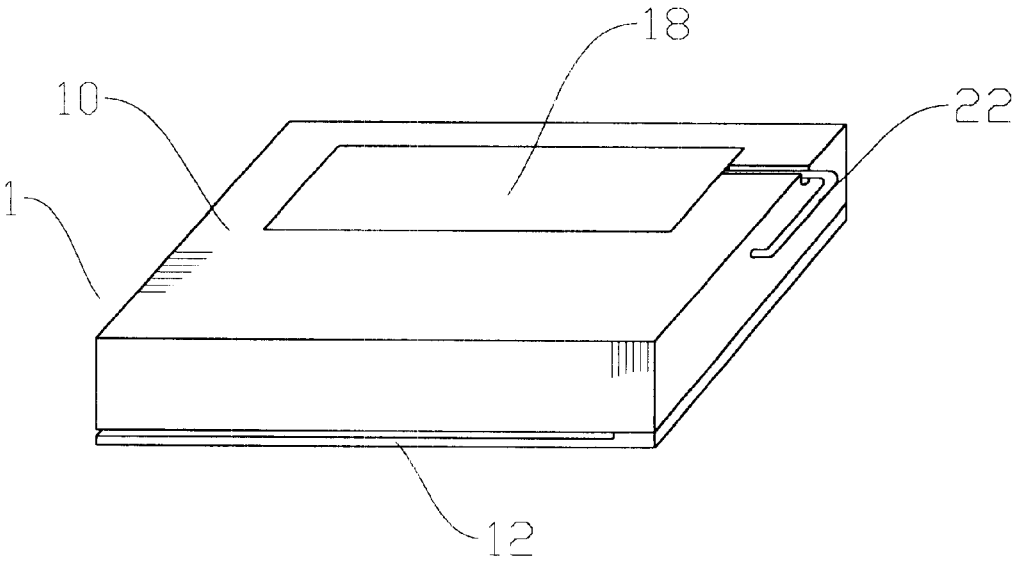
FIG. 5B shows the cover being placed at the close position.

There is shown the second embodiment of the present invention in FIGS. 5A and 5B. The USB cable receiving device further contains a cover 18 which is pivoted on one side of the receiving portion 14. When the user stores the USB cable 22, the USB plug head 20 is placed inside the receiving portion. The user may close the cover 18 as shown in FIG. 5B to prevent the dust, insects or other small parties intruding the receiving portion. The cover may employ a clipping mechanism to lock the receiving portion (not shown in the Figures) in order to secure the USB cable and plug head during transportation.

The foregoing mentioned USB cable receiving device is not only employed in the scanning device. It may utilize other peripherals such as digital cameras, digital video taping devices, printers and others. Moreover, the mechanism for receiving USB cable and USB plug head can also be used to receive other types of cables when the gap is properly adjusted.

Although preferred embodiments of the present invention have been described in the foregoing description and illustrated in the accompanying drawings, it will be understood that the invention is not limited to the embodiments disclosed, but is capable of numerous rearrangements, modifications, and substituting of parts and elements without departing from the spirit and scope of the invention. Accordingly, the present invention is intended to encompass such rearrangements, modifications, and substitutions of parts and elements as fall within the scope of the appended claims.

What is claimed is:

1. An apparatus for receiving a USB cable and a USB plug head, comprising:

a receiving portion located at a predetermined position, which is caved under the surface of a peripheral device, for receiving said USB cable and said USB plug head;

at least a clip placed inside said receiving portion for securing said USB cable; and at least a USB plug base placed inside said receiving portion for holding said USB plug head, wherein said USB plug base comprises:

a first side plate mounted on said receiving portion by a predetermined degree; and a first fixing plate mounted on said first side plate and forming a plug space for holding said USB plug head.

2. The apparatus of claim 1, further comprising a cover pivoted on one side of said receiving portion for close said receiving portion.

3. The apparatus of claim 1, further comprising a guiding opening located between said receiving portion and one edge of said peripheral device, for placing said USB cable to outside.

4. The apparatus of claim 1, wherein said clip is an elastic material and maintains a gap from one side of said receiving portion for securing said USB cable.

5. The apparatus of claim 1, wherein said peripheral device is a scanning device.

6. The apparatus of claim 1, wherein said predetermined position is the bottom portion said peripheral device.

7. The apparatus of claim 1, wherein said predetermined position is the side portion of said peripheral device.

8. The apparatus of claim 1, wherein said predetermined degree is less than ninety degrees.

9. The apparatus of claim 1, wherein said USB plug base comprises:

a first side plate mounted on said receiving portion;

a second side plate mounted on said receiving portion;

a first fixing plate mounted on said first side plate; and a second fixing plate mounted on said second side plate, wherein said second fixing plate along with said first side plate, said second side plate and said first fixing plate forms a plug space to secure said USB plug head.

10. An apparatus for receiving a cable and a plug head, comprising:

a receiving portion located at a predetermined position, which is caved under the surface of a peripheral device, for receiving said cable and said plug head;

at least a clip placed inside said receiving portion for securing said USB cable; and at least a plug base placed inside said receiving portion for holding said USB plug head, wherein said plug base comprises:

a first side plate mounted on said receiving portion by a predetermined degree; and a first fixing plate mounted on said first side plate and forming a plug space for holding said plug head.

11. The apparatus of claim 10, further comprising a cover pivoted on one side of said receiving portion for close said receiving portion.

12. The apparatus of claim 10, further comprising a guiding opening located between said receiving portion and one edge of said peripheral device, for placing said USB cable to outside.

13. The apparatus of claim 10, wherein said clip is an elastic material and maintains a gap from one side of said receiving portion for securing said cable.

14. The apparatus of claim 10, wherein said peripheral device is a scanning device.

15. The apparatus of claim 10, wherein said predetermined position is the bottom portion said peripheral device.

16. The apparatus of claim 10, wherein said predetermined position is the side portion of said peripheral device.

17. The apparatus of claim 10, wherein said predetermined degree is less than ninety degrees.

18. The apparatus of claim 10, wherein said USB plug base comprises:

a first side plate mounted on said receiving portion;

a second side plate mounted on said receiving portion;

a first fixing plate mounted on said first side plate; and a second fixing plate mounted on said second side plate, wherein said second fixing plate along with said first side plate, said second side plate and said first fixing plate forms a plug space to secure said plug head.

19. An apparatus for receiving a USB cable and a USB plug head, comprising:

a receiving portion located at a predetermined position, which is caved under the surface of a peripheral device, for receiving said USB cable and said USB plug head;

at least a clip placed inside said receiving portion for securing said USB cable; and at least a USB plug base placed inside said receiving portion for holding said USB plug head, wherein said USB plug base comprises:

a first side plate mounted on said receiving portion;

a second side plate mounted on said receiving portion;

a first fixing plate mounted on said first side plate; and a second fixing plate mounted on said second side plate, wherein said second fixing plate along with said first side plate, said second side plate and said first fixing plate forms a plug space to secure said USB plug head.

20. An apparatus for receiving a cable and a plug head, comprising:

a receiving portion located at a predetermined position, which is caved under the surface of a peripheral device, for receiving said cable and said plug head;

at least a clip placed inside said receiving portion for securing said USB cable; and at least a plug based placed inside said receiving portion for holding said USB plug head, wherein said USB plug base comprises:

a first side plate mounted on said receiving portion;

a second side plate mounted on said receiving portion;

a first fixing plate mounted on said first side plate; and a second fixing plate mounted on said second side plate, wherein said second fixing plate along with said first side plate, said second side plate and said first fixing plate forms a plug space to secure said plug head.

* * * * *